US006437496B1

(12) United States Patent
Kim et al.

(10) Patent No.: US 6,437,496 B1
(45) Date of Patent: Aug. 20, 2002

(54) TENSIONED SHADOW MASK AND COLOR CATHODE RAY TUBE ADOPTING THE SAME

(75) Inventors: Wan Kim, Yongin; Soon-chul Shin; Gwang-soo Kang, both of Suwon, all of (KR)

(73) Assignee: Samsung SDI Co., LTD, Kyungki-Do (KR)

( * ) Notice: Subject to any disclaimer, the term of this patent is extended or adjusted under 35 U.S.C. 154(b) by 0 days.

(21) Appl. No.: 09/465,763

(22) Filed: Dec. 17, 1999

(30) Foreign Application Priority Data

Jun. 30, 1999 (KR) ..... 99-25812

(51) Int. Cl.[7] ..... H01J 29/07; H01J 29/80; H01J 29/81

(52) U.S. Cl. ..... 313/402; 313/403; 313/404; 313/407; 313/408; 313/409

(58) Field of Search ..... 313/402, 403–409

(56) References Cited

U.S. PATENT DOCUMENTS

| | | | | | |
|---|---|---|---|---|---|
| 3,973,965 | A | * | 8/1976 | Suzuki et al. | 96/36.1 |
| 4,296,189 | A | | 10/1981 | Kuzminski | 430/5 |
| 4,727,280 | A | | 2/1988 | Fujimura | 313/402 |
| 4,926,089 | A | | 5/1990 | Moore | 313/403 |
| 4,942,332 | A | | 7/1990 | Adler et al. | 313/402 |
| 5,030,881 | A | * | 7/1991 | Marks et al. | 313/403 |
| 5,583,391 | A | | 12/1996 | Good et al. | 313/402 |
| 6,057,640 | A | * | 5/2000 | Aibara | 313/403 |

FOREIGN PATENT DOCUMENTS

| | | | | |
|---|---|---|---|---|
| EP | 487106 A1 | | 5/1992 | H01J/29/07 |
| FR | 2702881 A1 | * | 3/1994 | H01J/29/07 |
| JP | 57-065650 | | 4/1982 | H01J/29/07 |

* cited by examiner

*Primary Examiner*—Nimeshkumar D. Patel
*Assistant Examiner*—Sikha Roy
(74) *Attorney, Agent, or Firm*—Leydig, Voit & Mayer, Ltd.

(57) ABSTRACT

A tensioned shadow mask for a color cathode ray tube (CRT) adopting the same. In the color CRT including a faceplate on an inner side, a phosphor screen, a tensioned mask, and frame assembly secured to the faceplate, a funnel connected to the faceplate, the funnel having a neck portion and a cone portion, an electron gun in the neck portion of the funnel, and a deflection yoke on the cone portion of the funnel, the tensioned mask including a series of parallel strips separated by slits at an interval, tie bars interconnecting adjacent strips and defining slits at intervals, and dummy bridges disposed between adjacent tie bars, the dummy bridges respectively extending from adjacent strips toward each other in respective slits but not interconnecting the adjacent strips.

5 Claims, 10 Drawing Sheets

TENSIONED SHADOW MASK AND COLOR CATHODE RAY TUBE ADOPTING THE SAME

BACKGROUND OF THE INVENTION

1. Field of the Invention

The present invention relates to a color cathode ray tube (CRT), and more particularly, to a tensioned shadow mask with a color selection function, which has dummy bridges with an improved structure, and a color CRT adopting the same.

2. Description of the Related Art

Color CRTs for televisions and computer displays employ a shadow mask (hereinafter, simply referred to as a mask) for accurate landing of three electron beams emitted from an electron gun on each phosphor of a phosphor screen. The mask includes a dot mask with substantially circular apertures a slot mask with parallel elongated apertures, and a tensioned mask to which tension is applied from opposite sides thereof, and having series of parallel strips separated by slits through which electron beams pass.

FIG. 1 shows an example of a tensioned mask. As shown in FIG. 1, the tensioned mask formed of a foil includes a plurality of strips 12 separated by slits 11 having a predetermined interval, and a plurality of tie bars 13 which interconnect the adjacent strips to define the slits 11 at predetermined intervals.

In the mask, the tie bars 13 which interconnect the adjacent strips 12 can reduce a howling phenomenon, which occurs due to mask vibration from external impact, and unacceptable Poisson's contraction. However, if the vertical pitch PV of the tie bars 23 is too large, that is, if the vertical pitch PV of the tie bars 23 is twice or more the horizontal pitch PH thereof, a reflection image of the tie bars 13 is shown on the screen, which is unpleasant to viewers.

To avoid this problem, U.S. Pat. No. 4,926,089 discloses a tensioned mask as shown FIG. 2. As shown FIG. 2, a tensioned mask 20 includes a plurality of strips 21 separated by slits 22 having a predetermined interval, and tie bars 23 which interconnect the adjacent strips 21. Also, dummy bridges 24, which extend partially between but not interconnecting adjacent strips, are disposed between the adjacent tie bars 23 to separate each slit 21 into sub-slits having a predetermined interval.

In the tensioned mask, due to a technical problem in mask pattern formation, the width WI of the dummy bridges 24 is smaller than the width W2 of the tie bars 23. Thus, the reflection images by the dummy bridges 24 and the tie bars 23 have a slight difference in intensity of light. This difference raises the problem of tie bar visibility, thus deteriorating display image and making viewing unpleasant.

In formation of the phosphor screen on the inner side of a faceplate, as shown in FIG. 3, a tensioned mask and frame assembly is secured to a faceplate 100, and then subjected to an exposure process for forming a phosphor screen 101, wherein an exposure lamp 102 for use in the exposure process is long enough to irradiate a region corresponding to the vertical pitch between adjacent tie bars 23 or that of adjacent dummy bridges 24 of the tensioned mask 20. However, in the phosphor screen formation using the exposure lamp 102, red phosphor, blue phosphor and green phosphor are not completely excited, resulting in black matrix pattens in the nonexcited regions, as shown in FIG. 4. This problem is associated with the offset configuration of the dummy bridges 24 of the tensioned mask 20. In particular, as shown in FIG. 2, the dummy bridges 24 of the tensioned mask 20 extend from a strip 21' toward the adjacent strip 21", to define gaps near the strip 21". Accordingly, regions of the phosphor patterns that correspond to the offset protrusions of the dummy bridges 24, except for regions that correspond to the gaps between the dummy bridges 24 and the strip 21", are not excited by the electron beams emitted from the electron gun, so that the black matrix remains therein. Such intrusion of the black matrix into the red, blue and green phosphor patterns reduces the emission area of the phosphors, and regions, which are not excited due to the dummy bridges 24 are also shown in a screen, thereby lowering appearance uniformity.

SUMMARY OF THE INVENTION

An object of the present is to provide a tensioned shadow mask and a color cathode ray tube (CRT) adopting the same, capable of eliminating intrusion of a black matrix into phosphor patterns during phosphor screen formation, due to dummy bridges.

Another object of the present invention is to provide a tensioned mask and a color CRT adopting the same, capable of eliminating the problem of tie bar visibility.

According to an aspect of the present invention, there is provided a tensioned shadow mask for a cathode ray tube (CRT), comprising: a series of parallel strips separated by slits having a predetermined interval; a plurality of tie bars interconnecting adjacent strips to define a plurality of slits at predetermined intervals; and a plurality of dummy bridges disposed between adjacent tie bars, the dummy bridges extending between the adjacent strips and facing each other, but not interconnecting the adjacent strips.

Preferably; the area of the dummy bridges is equal to that of the tie bars, or the area difference between the dummy bridges and the tie bars is in a predetermined range.

According to another aspect of the present invention, there is provided a color cathode ray tube (CRT) including a faceplate having on the inner side thereof a phosphor screen, a tensioned mask and frame assembly secured into the faceplate, which is an assembly of a tensioned mask and a frame, a funnel connected to the faceplate, the funnel having a neck portion and a cone portion, an electron gun inserted in the neck portion of the funnel, and a deflection yoke installed in the cone portion of the funnel, wherein the tensioned mask comprises: a series of parallel strips separated by slits having a predetermined interval; a plurality of tie bars interconnecting adjacent strips to defines a plurality of slits at predetermined intervals; and a plurality of dummy bridges disposed between adjacent tie bars, the dummy bridges extending between the adjacent strips and facing each other, but not interconnecting the adjacent strips.

BRIEF DESCRIPTION OF THE DRAWING

The above object and advantages of the present invention will become more apparent by describing in detail preferred embodiments thereof with reference to the attached drawings in which.

DESCRIPTION OF THE PREFERRED EMBODIMENTS

Figure 1:
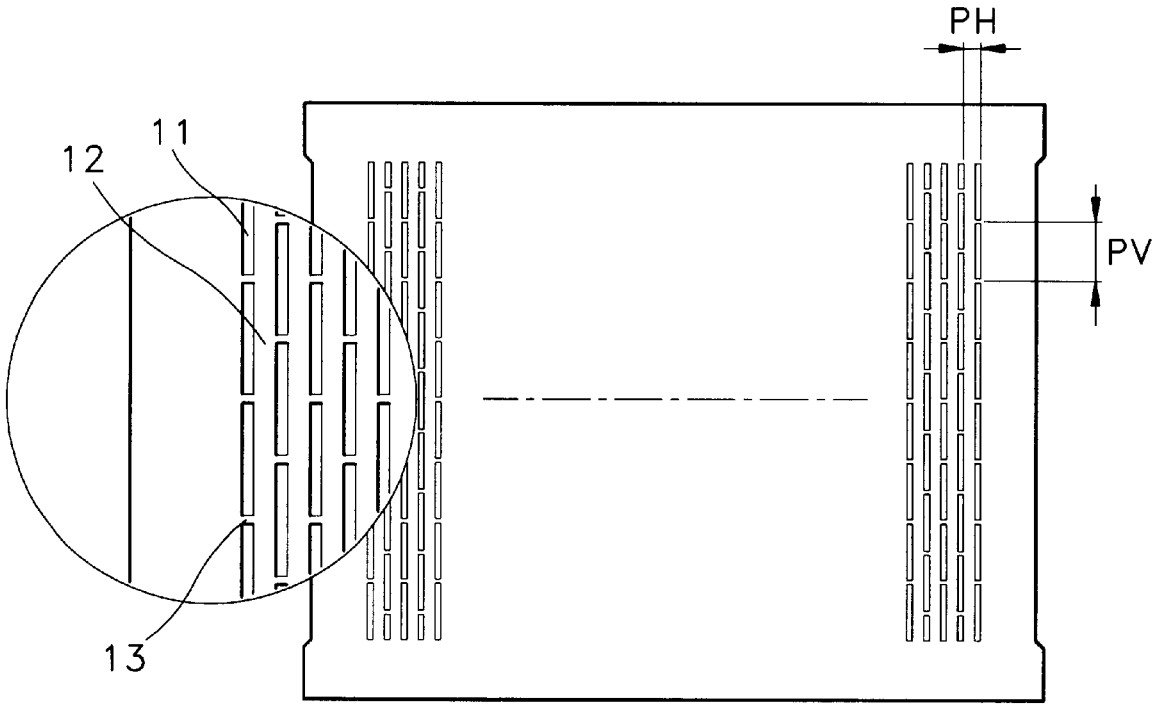
FIG. 1 (PRIOR ART)
FIG. 1 is a plan view of a conventional tensioned mask for a color cathode ray tube (CRT)
Figure 2:
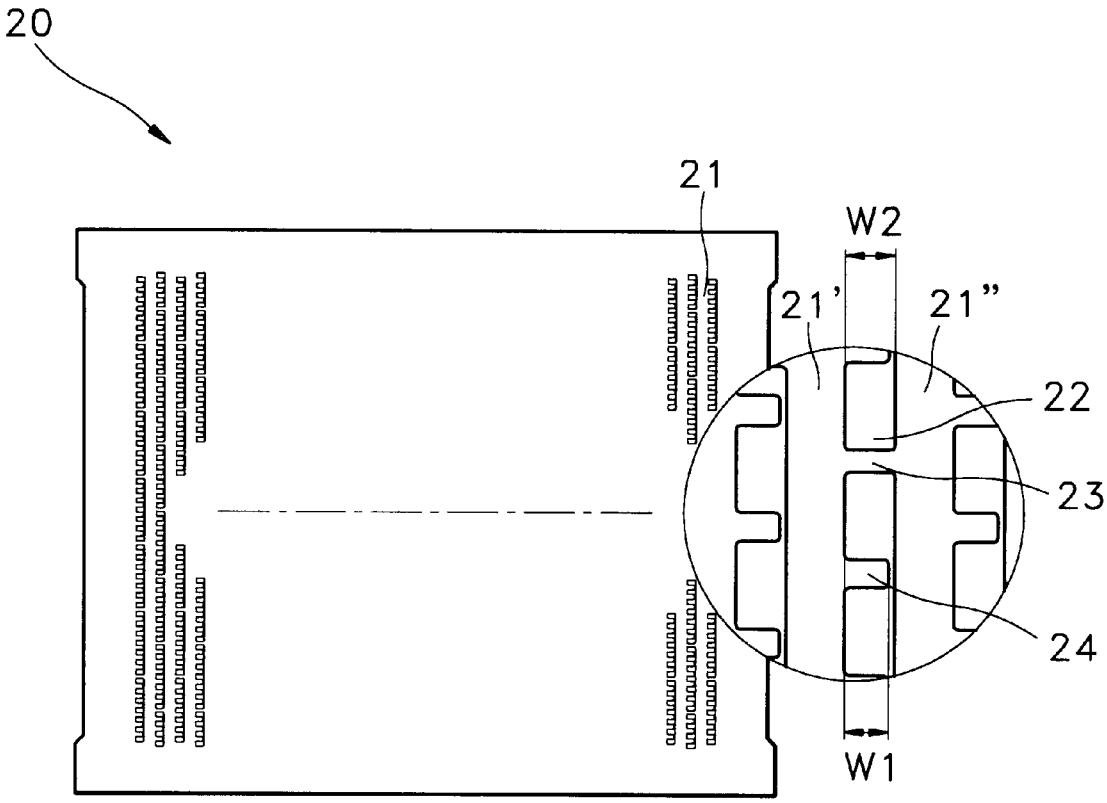
FIG. 2 (PRIOR ART)
FIG. 2 is a plan view of another conventional tensioned mask for a color CRT.
Figure 3:
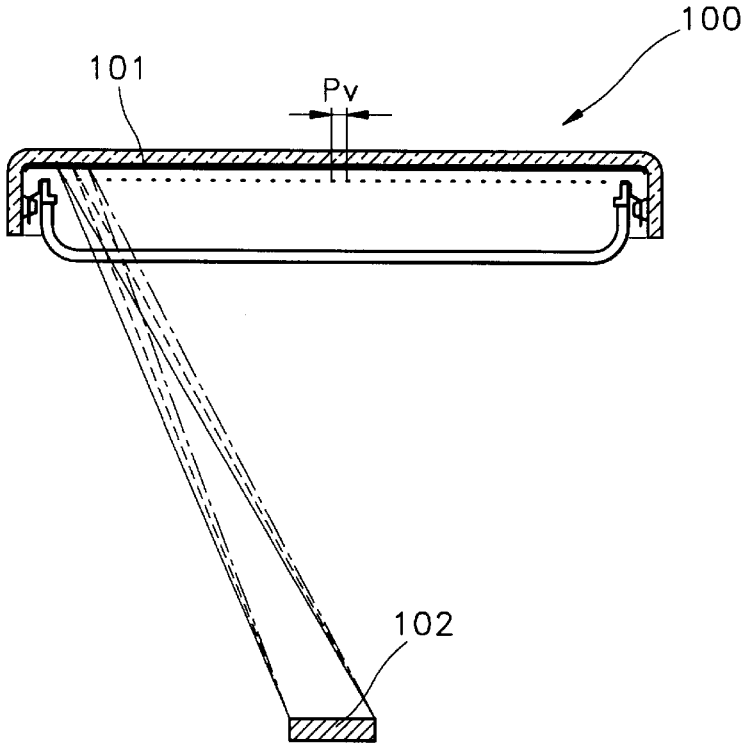
FIG. 3 is a diagram illustrating an exposure process in a state where a tensioned mask is secured onto a faceplate.
Figure 4:
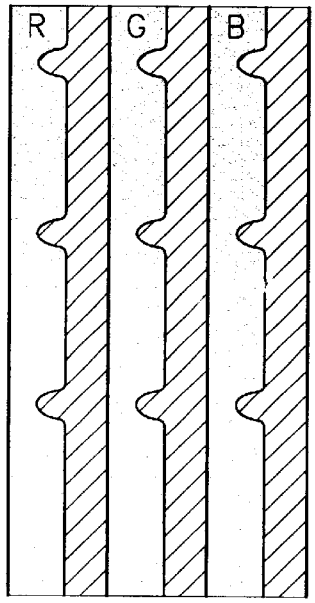
FIG. 4 (PRIOR ART)
FIG. 4 shows phosphor patterns obtained by exposing a phosphor screen using the tensioned mask of FIG. 2.
Figure 5:
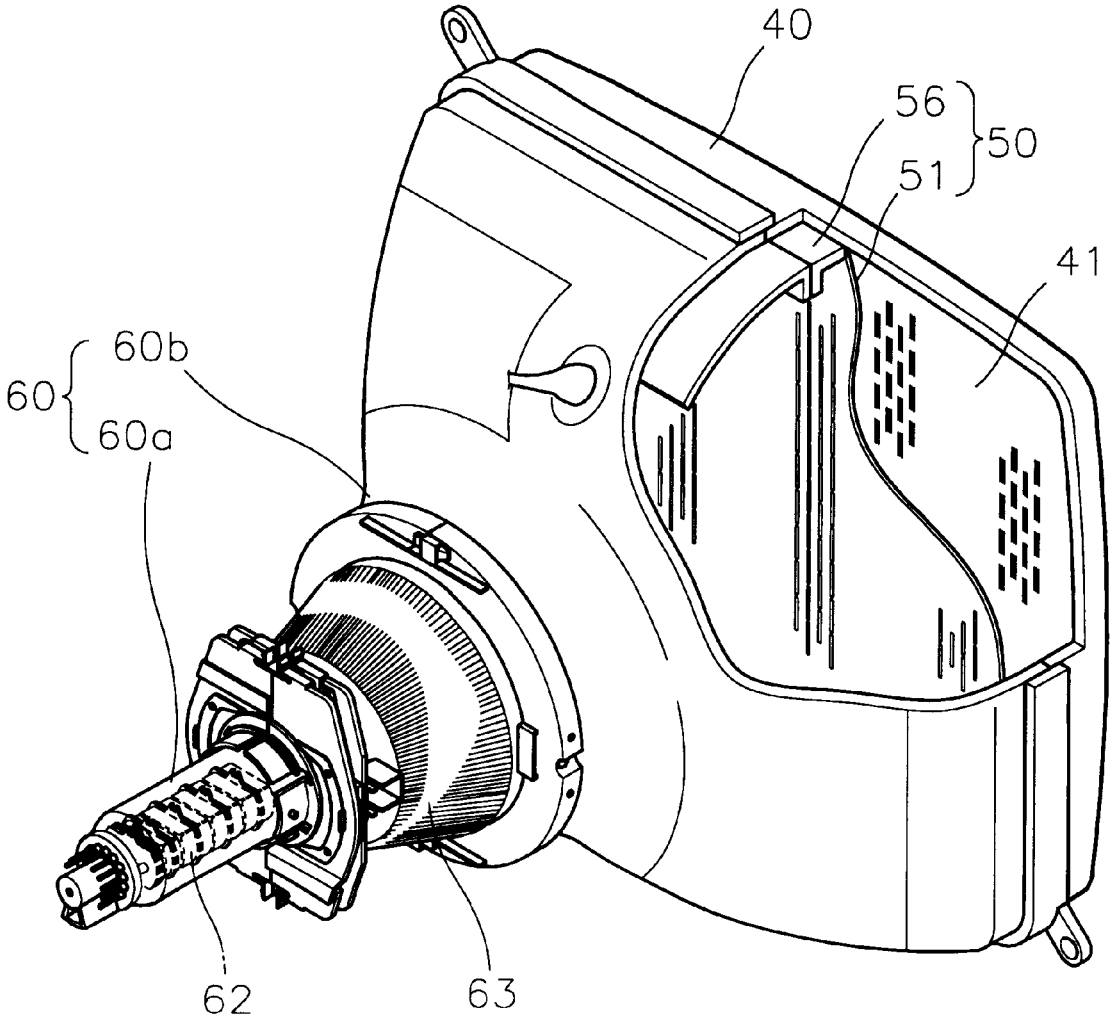
FIG. 5 is a perspective view of a color CRT according to the present invention.

As shown in FIG. 5, a general color cathode ray tube (CRT) includes a faceplate 40 having on the inner side thereof a phosphor screen 41 with a predetermined pattern, a tensioned mask and frame assembly 50 secured onto the faceplate 40, which is an assembly of a tensioned mask 51 and a frame 56, a funnel 60 connected to the faceplate 40, which has a neck portion 60*a* and a cone portion 60*b*, an electron gun 62 inserted in the neck portion 60*a* of the funnel 60, for emitting electron beams through apertures of the tensioned mask 51 to excite the phosphor screen 41, and a deflection yoke 63 surrounding the cone portion 60*b* and the neck portion 60*a* of the funnel 60, for deflecting the electron beams emitted from the electron gun 62.

Figure 6:
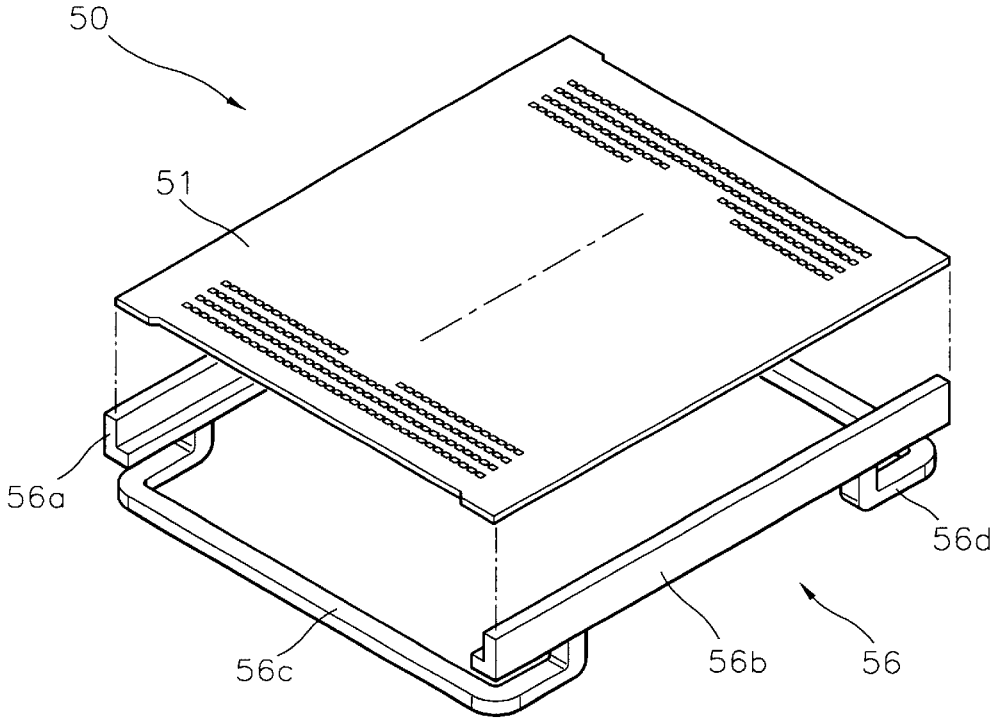
FIG. 6 is an exploded perspective view showing a tensioned mask according to the present invention secured to a frame.

In particular, in the phosphor screen 41 disposed on the inner side of the faceplate 40, phosphors producing light of red, blue and green colors are deposited in a dotted or striped shape. The tensioned mask and frame assembly 50, as shown in FIG. 6, includes the tensioned mask 51 having apertures through which electron beams emitted from the electron gun 62 pass, and the frame 56 for supporting the tensioned mask 51 in tension.

Figure 7:
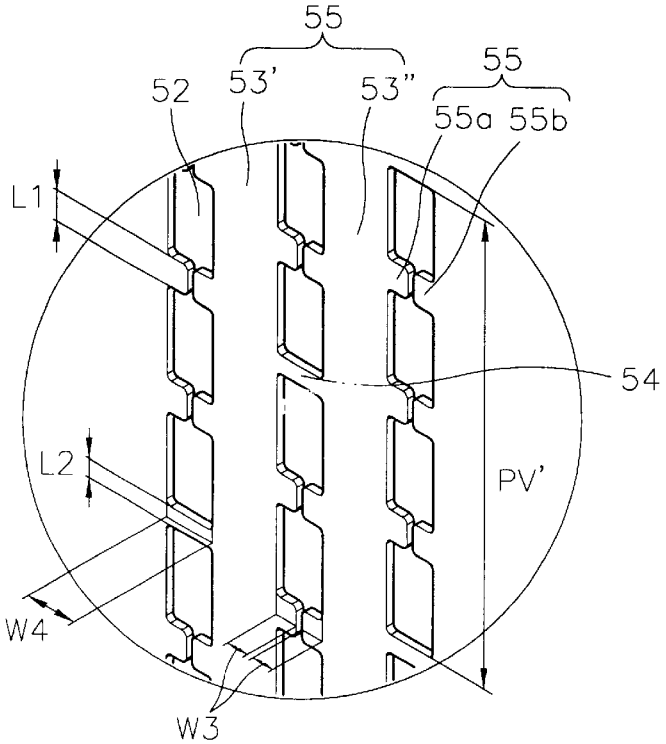
FIG. 7 is a partial enlarged view of the tensioned mask of FIG. 6, illustrating an aperture configuration thereof.

As shown in FIG. 7, in the tensioned mask 51, which is formed of a 50–100 $\mu$m-thick foil, a series of strips 53 having a width of 190 $\mu$m are separated by slits 52 having a predetermined interval. The slits 52 are separated by tie bars 54 which interconnect adjacent strips 53' and 53" and have a relatively large vertical pitch PV', compared to dummy bridges. Also, a plurality of dummy bridges 55, which define the slits 52 at predetermined intervals, are disposed between the tie bars 54, wherein the dummy bridges extend between but do not interconnect adjacent strips.

In particular, the dummy bridges 55, which define the slits 52 at predetermined intervals, include first and second protrusions 55*a* and 55*b* which extend between the adjacent strips 53' and 53" and face each other, wherein the first and second protrusions 55*a* and 55*b* do not contact each other.

In the present embodiment, preferably, the length L1 of the dummy bridges 55 is greater than the length L2 of the tie bars 54. For example, the length L1 of the dummy bridges 55, i.e., the width in the direction of the strips 53, may be in the range of 100 to 120 $\mu$m, and the length L2 of the tie bars 54 may be in the range of 55 to 90 $\mu$m. Also, the width W3 of the dummy bridges 55 (the sum of the width of the first and second protrusions 55*a* and 55*b*) is less than the width W4 of the tie bars 54. Preferably, the area A1 (=L1×W3) of the dummy bridges 64 is equal to the area A2 (=L2×W4) of the tie bars 54, or the area difference between the dummy bridges 55 and the rear tie bars 54 is in a predetermined range. For example, in a mask for monitors, the width W3 of the dummy bridges 55 is 30 $\mu$m which is equal to the sum of a width of 15 $\mu$m of the first and second protrusions 55*a* and 55*b* extending from the adjacent strips 53' and 53", respectively. Also, in a mask for televisions, the width W3 of the dummy bridges 55 is 145 $\mu$m which is equal to the sum of a width of 72.5 $\mu$m of the first and second protrusions 55*a* and 55*b* extending from the adjacent strips 53' and 53", respectively. The area of the dummy bridges 55 may differ from that of the tie bars 54. However, it is preferable that the area of the dummy bridges 55 be equal to that of the tie bars 54, so that the tie bars will not visibly stand out. Preferably, the area difference between the dummy bridges 55 and the tie bars 54 is in the range of 30 percent, which is expressed by $|(A1-A2)|/A2 \leqq 0.3$.

Also, as shown in FIG. 6, the frame 56 of the tensioned mask and frame assembly comprises a pair of supports 56*a* and 56*b* spaced a predetermined distance, for supporting the longer side edges of the tensioned mask 51, and a pair of elastic members 56*c* and 56*d* for applying tension to the tensioned mask 51, wherein both ends of the elastic members 56*c* and 56*d* are fixed to those of the support members 56*a* and 56*b*. The frame configuration is not limited to the above configuration, and any configuration capable of placing tension on the tensioned mask 51 can be adopted.

In the color CRT having the configuration of FIG. 5, electron beams emitted from the electron gun 62 inserted into the neck portion 60*a* of the funnel 60 are selectively diffracted by the deflection yoke 63 according to scanning positions in the phosphor screen, and then land through the slits 52 of the tensioned mask 51 on the phosphor screen, thereby forming an image thereon.

In the color CRT according to the present invention, which forms an image as mentioned above, phosphor patterns are uniformly formed over the phosphor screen, without intrusion of a black matrix into the phosphor patterns, so that the brightness and resolution of the display image are improved. In particular, in order to obtain a phosphor screen, a phosphor producing red, green or blue color light is deposited on the inner surface of the faceplate 40 on which a black matrix has been deposited, and an exposure process is carried out thereon while the tensioned mask and frame assembly 50 is fixed to the faceplate 40. During the exposure process, the phosphor exposed through the gap between the first and second protrusions 55*a* and 55*b* of the dummy bridges 55 can be excited, without causing non-excited regions due to the dummy bridges 55 in the phosphor screen. This is due to the configuration of the dummy bridges 55, in which the first and second protrusions 55*a* and 55*b* extend, facing each other between adjacent strips, but not interconnecting the adjacent strips.

During the operation of the color CRT, the phosphors of the phosphor screen 41 cannot be completely excited by the electron beams emitted from the electron gun, due to the tie bars 54 and the dummy bridges 55, which define the slits 52 at predetermined intervals and shield electron beams emitted from the electron gun, thus resulting in a reflection image thereby on the screen. However, since in the present invention the length L1 of the dummy bridges 55 is longer than the length L2 of the tie bars 54 such that the area of the dummy bridges 55 is almost equal to that of the tie bars 54, the reflection image area due to the tie bars 54, which corresponds to a nonexcited region of the phosphor screen, is similar to that due to the dummy bridges 55. As a result, real image and reflection image are uniformly distributed over the screen, so that viewers scarcely perceive the reflection image, thereby improving appearance uniformity. The reflection image distribution can be controlled by varying the number of tie bars 55 and dummy bridges 54.

The following embodiments are provided so that this disclosure will be thorough and complete.

EXPERIMENTAL EXAMPLE 1

The appearance uniformity with respect to the area difference between the tie bars and the dummy bridges was observed by varying the length of the dummy bridges relative to the length of the tie bars in a tensioned mask of a CRT for monitors. The result is shown in Table 1.

TABLE 1

| | Tie bar | | | Dummy bridge | | | | |
|---|---|---|---|---|---|---|---|---|
| Sample | Length (μm) | Width (μm) | Area (μm²) | Length (μm) | Width (μm) | Area (μm²) | Area ratio (%) | Appearance Uniformity |
| 1 | 60 | 60 | 3,600 | 60 | 30 | 1,800 | 50 | poor |
| 2 | 60 | 60 | 3,600 | 90 | 30 | 1,800 | 75 | moderate |
| 3 | 60 | 60 | 3,600 | 120 | 30 | 1,800 | 100 | good |
| 4 | 60 | 60 | 3,600 | 150 | 30 | 1,800 | 125 | moderate |

As can be noted from Table 1, the appearance uniformity is acceptable when the area of the tie bars is in an range greater than 70% and less than 130% of the area of the tie bars.

Figure 8:
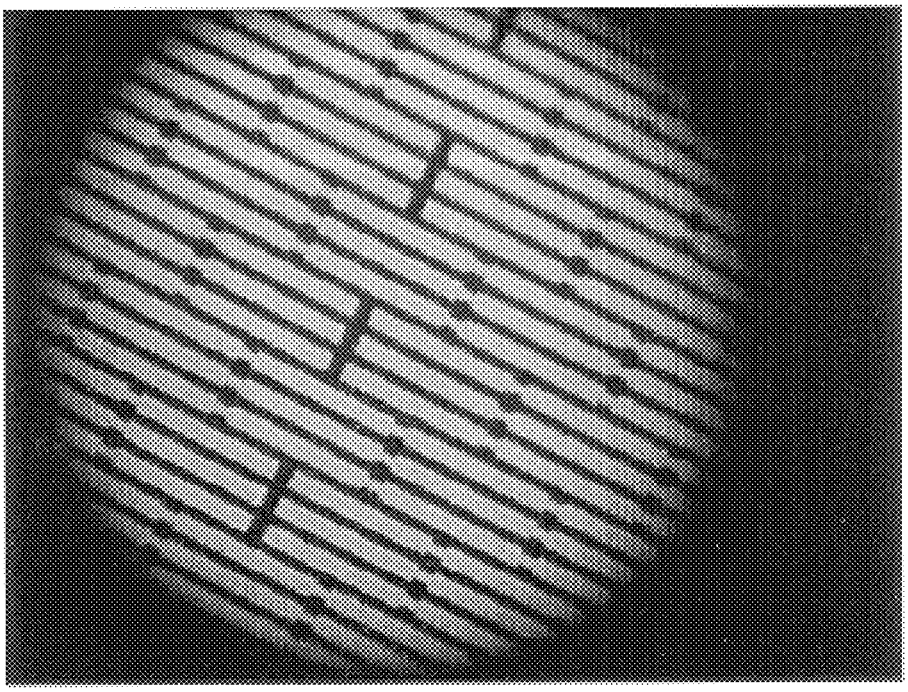
FIGS. 8 and 17 are photos illustrating the visibility of tie bars reflected on a phosphor screen with respect to the area difference between the tie bars and dummy bridges of tensioned masks.
Figure 9:
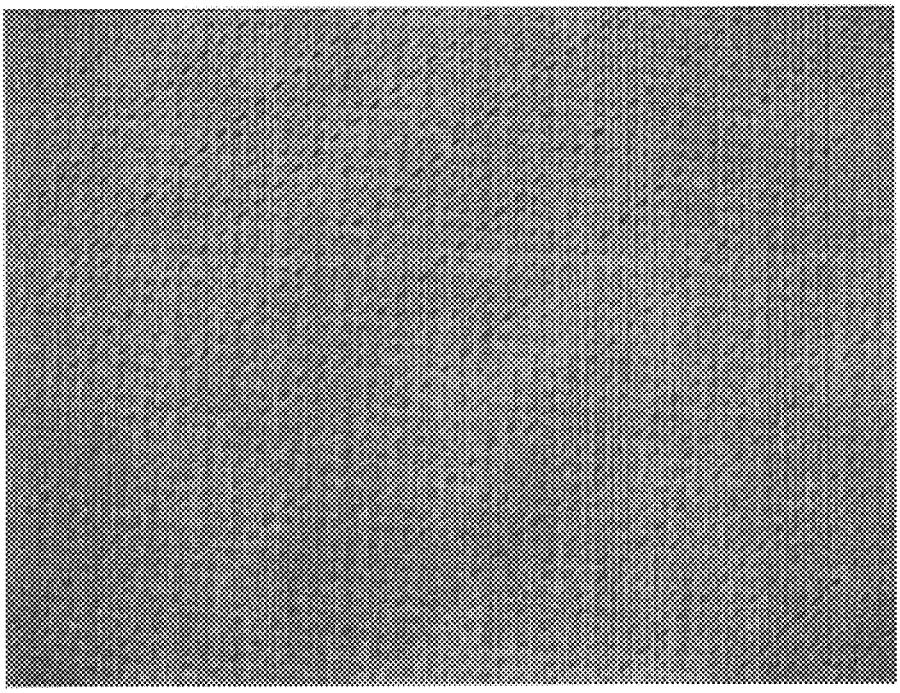

FIGS. 8 through 13 are photos illustrating the visibility of tie bars reflected on the phosphor screen, with respect to the area difference between the tie bars and dummy bridges of tensioned masks shown in Table 1. In particular, FIG. 9 is a macro photo in a case when the area of the dummy bridges is 50% of that of the tie bars (Sample 1 of Table 1), and FIG. 8 is a 20X-magnified photo of FIG. 9. As shown in FIGS. 8 and 9, distinct tie bar shadows appear on the phosphor screen.

Figure 10:
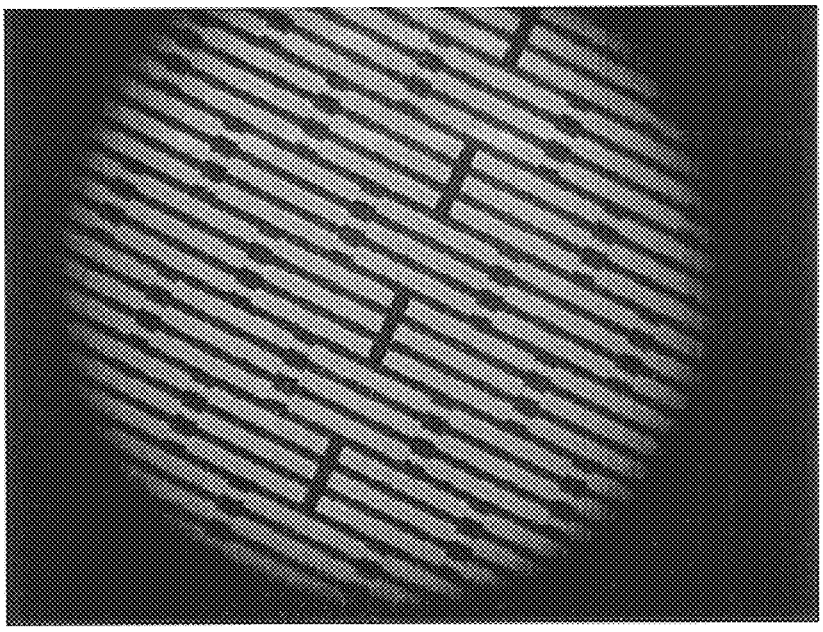
Figure 11:
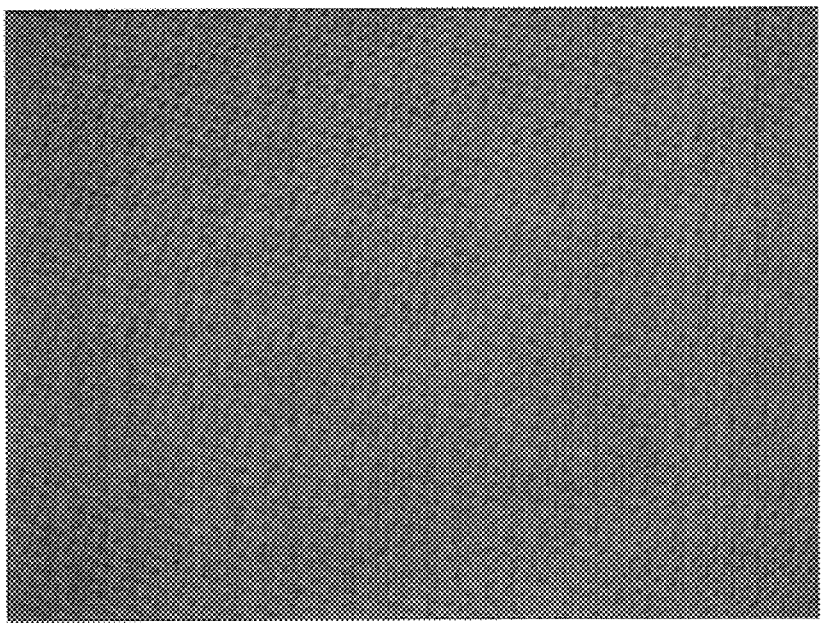

FIG. 11 is a macro photo showing the tie bar visibility on the phosphor screen when the area of the dummy bridges is 75% of that of the tie bar (Sample 2 of Table 1), and FIG. 10 is a 20×-magnified photo of FIG. 11. As shown in FIG. 10, the sizes of the reflection image by the tie bars and the dummy bridges appears to be equal to each other, showing a slight difference in intensity of light therebetween. Also, as shown in FIG. 11, it is difficult to distinguish the tie bar shadows on the phosphor screen from the dummy bridges shadows thereon.

Figure 12:
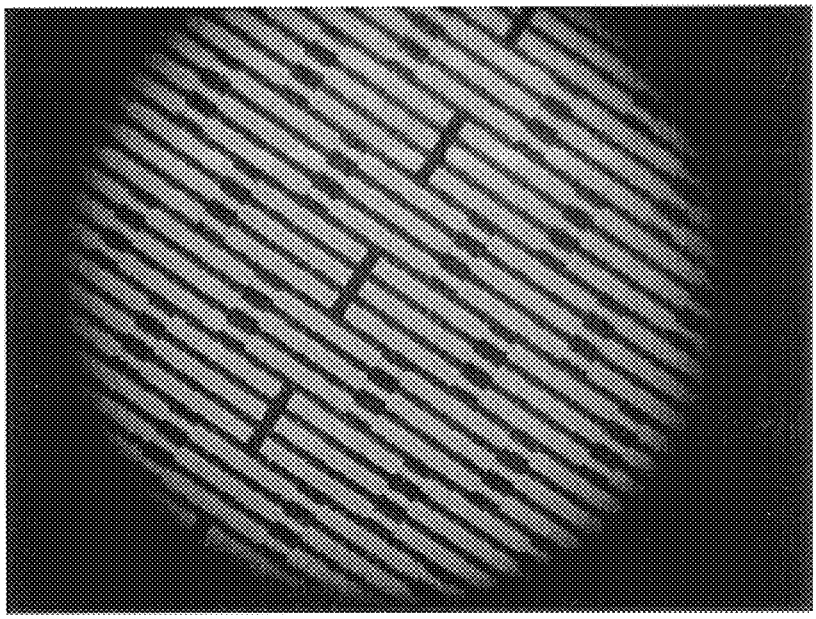
Figure 13:
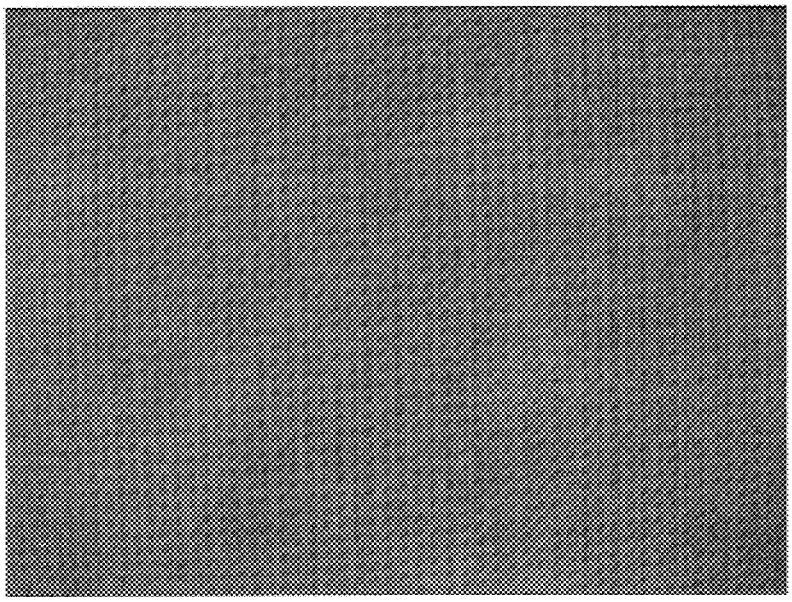

FIG. 13 is a macro photo showing the tie bar visibility on the phosphor screen when there is no difference in area between the tie bars and the dummy bridges (Sample 3 of Table 1), and FIG. 12 is a 20×-magnified photo of FIG. 13. In FIG. 12, the dummy bridges that are enlarged in the longitudinal direction so as to make the area of the dummy bridges equal to that of the tie bars are visible. As shown in FIG. 13, it is difficult to distinguish the tie bar shadows from the dummy bridges shadows, and the reflection images of the tie bars and dummy bridges show uniform intensity of light.

Although the photos of Sample 4 in Table 1, in which the area of the dummy bridges is 125% of that of the tie bars, were not taken, the size of the reflection image of the dummy bridges on the phosphor screen was large whereas that of the tie bars was small, compared to the Sample 3. Furthermore, the reflection image of the tie bars were shown as white dots on the screen.

EXPERIMENTAL EXAMPLE 2

The appearance uniformity with respect to the area difference between the tie bars and the dummy bridges was observed by varying the length of the dummy bridges relative to the length of the tie bars in a tensioned mask of a CRT for. televisions. The result is shown in Table 2.

TABLE 2

| | Tie bar | | | Dummy bridge | | | | |
|---|---|---|---|---|---|---|---|---|
| Sample | Length (μm) | Width (μm) | Area (μm²) | Length (μm) | Width (μm) | Area (μm²) | Area ratio (%) | Appearance Uniformity |
| 1 | 80 | 195 | 15,600 | 60 | 145 | 8,700 | 55 | poor |
| 2 | 80 | 195 | 15,600 | 80 | 145 | 11,600 | 74 | moderate |
| 3 | 80 | 195 | 15,600 | 108 | 145 | 15,660 | 100.3 | good |
| 4 | 80 | 195 | 15,600 | 140 | 145 | 20,300 | 130.1 | moderate |

As can be understood from Table 2, the appearance uniformity is acceptable when the area difference between the tie bars and dummy bridges is in the range of 30%.

Figure 14:
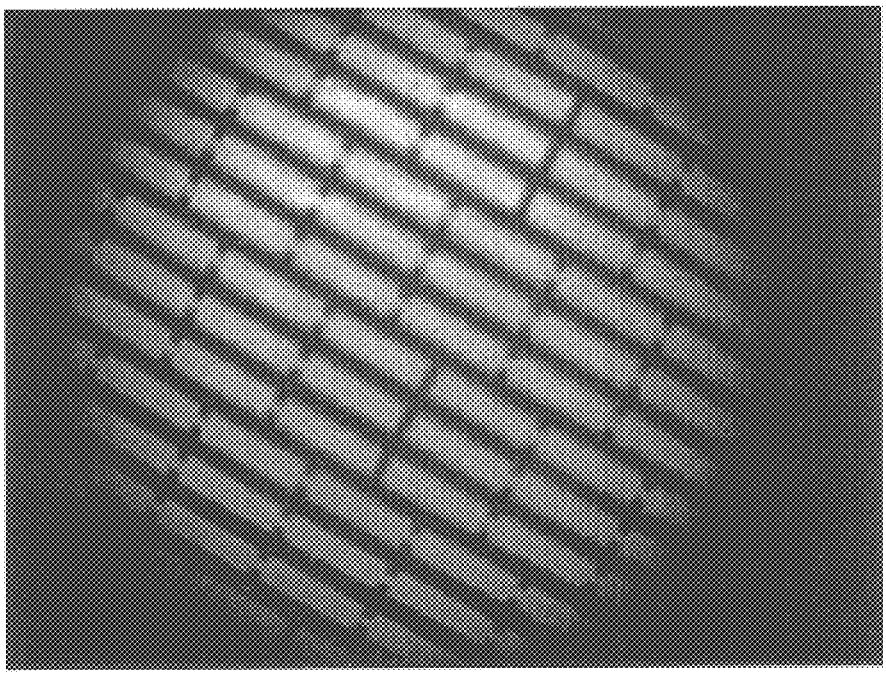
Figure 15:
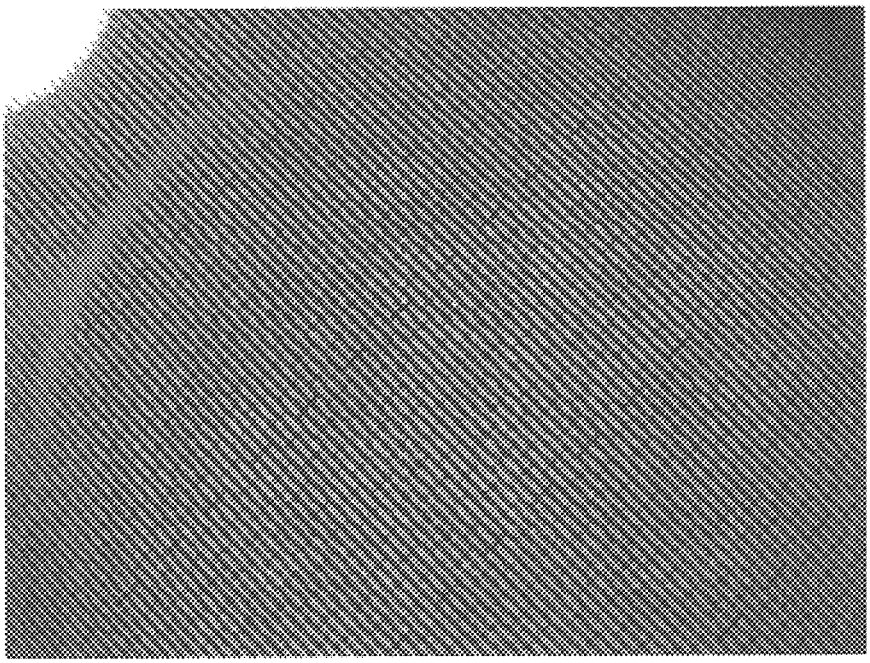

FIGS. 14 through 17 are photos illustrating the visibility of tie bars reflected on the phosphor screen, with respect to the area difference between the tie bars and dummy bridges of tensioned masks shown in Table 2. In particular, FIG. 15 is a macro photo in a case when the area of the dummy bridges is 55% of that of the tie bars (Sample 1 of Table 2), and FIG. 14 is a 10×-magnified photo of FIG. 15. As shown in FIGS. 14 and 15, although the resolution is poor, due to the large horizontal pitches of the phosphor pattern and the slit of the tensioned mask for televisions, compared to those for monitors (Experimental Example 1), distinct tie bar shadows appear on the screen.

Figure 16:
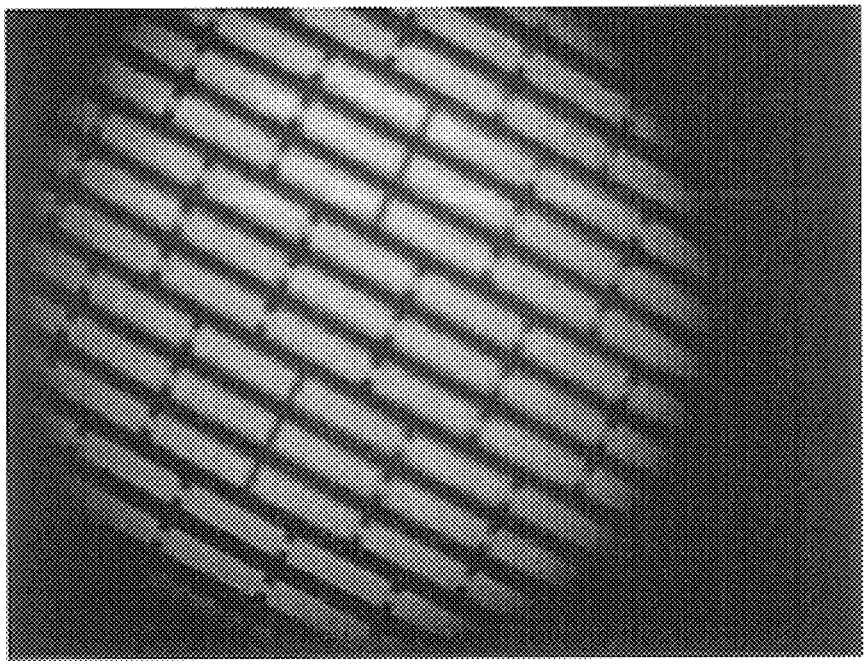
Figure 17:
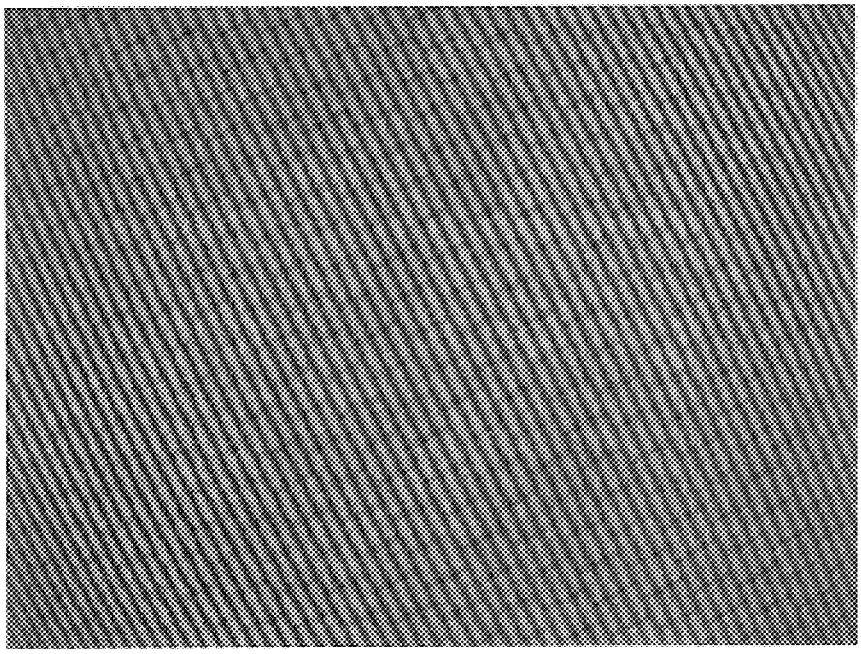

FIG. 17 is a macro photo showing the tie bar visibility on the phosphor screen when the area of the dummy bridges is 74% of that of the tie bars (Sample 2 of Table 2), and FIG. 16 is a 10×-magnified photo of FIG. 17. In FIG. 16, the dummy bridges that are enlarged in the longitudinal direction so as to make the area of the dummy bridges equal to that of the tie bars are distinct. As shown in FIG. 17, the reflection images of the tie bars and dummy tie bars have uniform intensity of light, so that it is difficult to distinguish the reflection image of the tie bars from that of the dummy tie bars, thus improving the appearance uniformity.

Although photos of the Sample 4 in Table 2, in which the area of the dummy bridges is 130% or more larger than that of the tie bars, were not taken, the size of the reflection image of the dummy bridges on the phosphor screen was large whereas that of the tie bars was small, compared to the samples described with reference to photos. Furthermore, the reflection image of the tie bars was shown as white dots on the screen.

While the present invention has been illustrated and described with reference to specific embodiments, further modifications and alterations within the spirit and scope of this invention as defined by the appended claims will become evident to those skilled in the art.

What is claimed is:

1. A tensioned shadow mask for a cathode ray tube (CRT), comprising:

a series of parallel strips extending along a first direction of the shadow mask and separated by respective slits spaced from each other at an interval;

a plurality of tie bars, each tie bar interconnecting, along the first direction, two of the slits and, along a second direction transverse to the first direction, interconnecting adjacent strips; and a plurality of dummy bridges, disposed between adjacent tie bars, pairs of the dummy bridges having first and second protrusions extending toward each other in a slit, from respective adjacent strips, but not interconnecting the adjacent strips.

2. The tensioned shadow mask of claim 1, wherein the first and second protrusions have, along the second direction, identical widths so that a gap between each pair of first and second protrusions is located at a center of, a slit.

3. The tensioned shadow mask of claim 1, wherein each of the dummy bridges and the tie bars have respective areas, and the area of each dummy bridge is in a range greater than 70% and less than 130% of the area of each tie bar.

4. A color cathode ray tube (CRT) including:

a faceplate having on an inner side a phosphor screen, a tensioned mask and frame assembly secured to the faceplate, a funnel connected to the faceplate, the funnel having a neck portion and a cone portion, an electron gun in the neck portion of the funnel, and a deflection yoke on the cone portion of the funnel, wherein the tensioned mask comprises:

a series of parallel strips extending along a first direction of the shadow mask and separated by respective slits spaced from each other at an interval;

a plurality of tie bars, each tie bar interconnecting, along the first direction, two of the slits and, along a second direction transverse to the first direction, interconnecting adjacent strips; and a plurality of dummy bridges, disposed between adjacent tie bars, pairs of the dummy bridges having first and second protrusions extending toward each other in a slit, from respective adjacent strips but not interconnecting the adjacent strips.

5. The color cathode ray tube of claim 4, wherein each of the dummy bridges and the tie bars have respective areas, and the area of each dummy bridge is in a range greater than 70% and less than 130% of the area of each tie bar.

* * * * *